United States Patent [19]

Wenrich

[11] Patent Number: 4,789,145

[45] Date of Patent: Dec. 6, 1988

[54] VANE SPRING FOR AIR MOTOR

[75] Inventor: Thomas C. Wenrich, Troutville, Va.

[73] Assignee: Ingersoll-Rand Company, Woodcliff Lake, N.J.

[21] Appl. No.: 947,602

[22] Filed: Dec. 30, 1986

[51] Int. Cl.[4] ..... F16F 1/18; F16F 1/14; F01C 1/00

[52] U.S. Cl. ..... 267/160; 267/154; 418/266

[58] Field of Search ..... 188/296, 306, 307; 267/150, 158, 160, 164, 154, 155; 418/266, 267, 248, 238, 23; 384/37

[56] References Cited

U.S. PATENT DOCUMENTS

| | | | |
|---|---|---|---|
| 2,357,333 | 9/1944 | Kendrick et al. | 418/267 X |
| 2,632,398 | 3/1953 | Ferris | 267/160 X |
| 2,665,642 | 1/1954 | De Ment et al. | 418/266 X |
| 3,962,768 | 6/1976 | Lusko | 267/160 X |
| 4,636,107 | 1/1987 | Casler et al. | 267/164 X |

FOREIGN PATENT DOCUMENTS

| | | | |
|---|---|---|---|
| 2418479 | 11/1974 | Fed. Rep. of Germany | 418/266 |

*Primary Examiner*—Andres Kashnikow
*Assistant Examiner*—Robert J. Oberleitner
*Attorney, Agent, or Firm*—Arthur N. Trausch

[57] ABSTRACT

A spring for radially biasing a slidable vane in an air motor vane slot includes two torsion coils, an offset base member connecting the coils and curved arm members extending from the coils. The offset base member reduces stress and allows a higher profile vane to be used. The arc shaped arm members redistribute wear or contact points and also allow a higher profile vane.

4 Claims, 1 Drawing Sheet

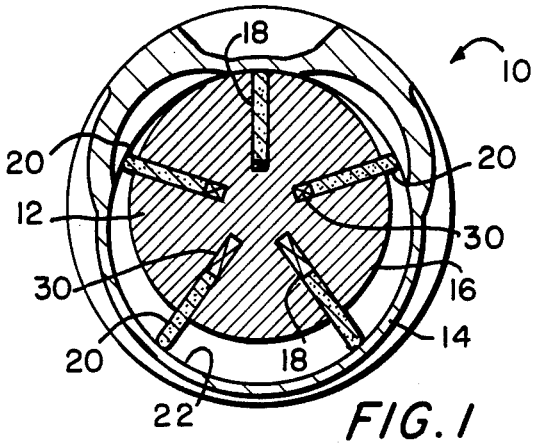
FIG. 1
FIG. 2
PRIOR ART
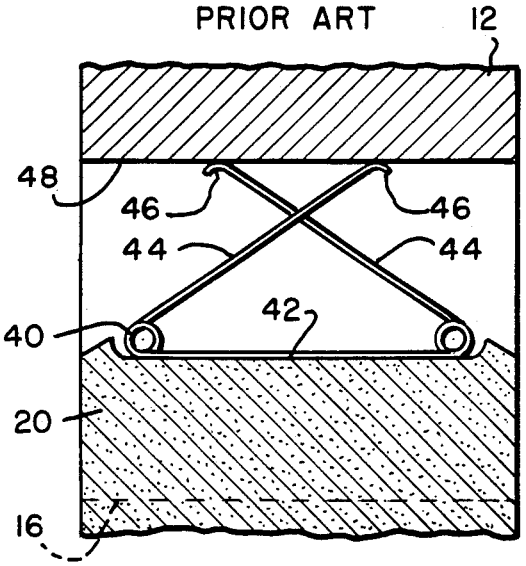
FIG. 4
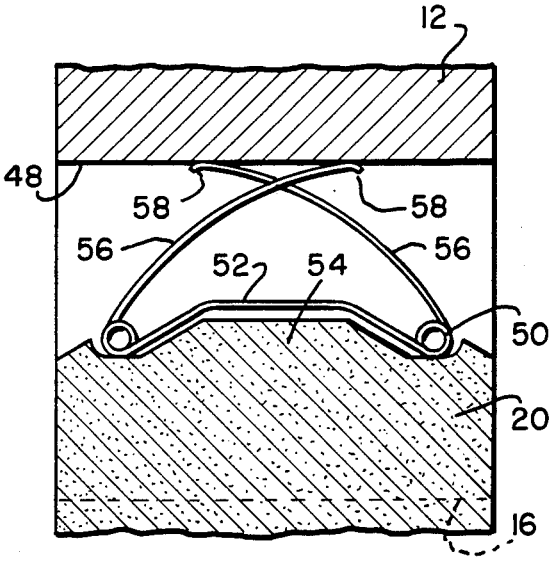
FIG. 3
PRIOR ART
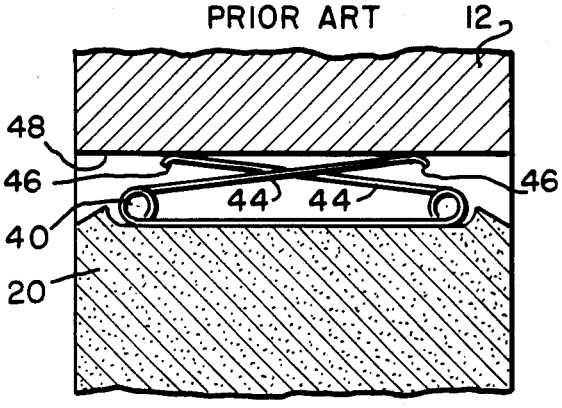
FIG. 5
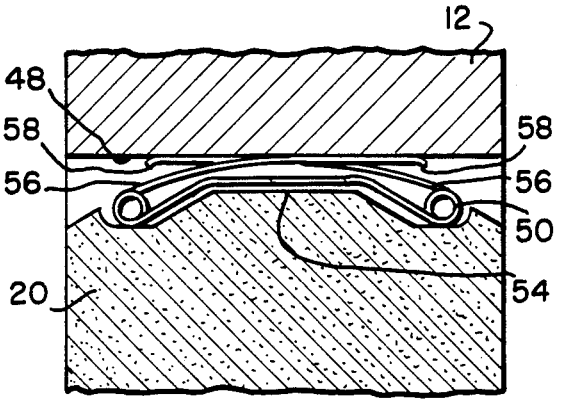

VANE SPRING FOR AIR MOTOR

BACKGROUND OF THE INVENTION

This invention relates to a spring for biasing a radially slidable vane in a rotary fluid power converter.

Fluid power converters such as vane-type air motors have a rotor with vanes free to slide in radial vane slots. The rotor is eccentrically mounted within an enclosed cylinder which allows the vanes to radially project from the rotor during the cycle of rotation. Fluid pressure acts on one side of the projecting vanes to create torque on the rotor shaft. The vanes are biased radially outward to seal against the cylinder. A good seal is especially important during start-up and for operation at low rotational speeds.

For vanes that are short in both radial height and axial length but have considerable radial travel, a double torsion spring having a conventional straight configuration is often used as the biasing mechanism. The conventional spring results in many spring failures and leakage around the vanes. A straight wire connects the two coils of the double torsion spring and supports the base of the vane. The vane base rubs against the connecting wire causing wear and eventually failure of the spring. A straight arm member extends from each coil and has rounded tips which abut against the bottom of the vane slot. As the motor rotates and the vanes move in and out of the slots, the springs deflect and the arm tips slide on the bottom of the vane slot. This sliding results in wear and eventual failure of the spring. At maximum vane extension, the short vane height results in a small portion of the vane remaining within the vane slot to support the pressure loaded cantilevered portion of the vane outside of the vane slot. Without adequate support in the slot, the vanes are subject to misalignment and increased wear and leakage around the vane.

An air motor with a broken spring or worn vanes does not operate efficiently and must be disassembled to replace the broken or worn parts. These repairs cause costly down time for a mechanism powered by an air motor.

The present invention is directed to various improvements in vane springs to overcome these problems.

SUMMARY OF THE INVENTION

One object of the present invention is to provide a vane spring for an air motor which reduces the wear of the spring and vane during operation.

Another object of the present invention is to provide a vane spring subject to less wear, thereby reducing spring failures.

Another object of the present invention is to provide a spring and vane construction that allows better continuous alignment of the vane, thereby reducing vane wear.

A further object of the present invention is to change the contact point of the spring arm with the bottom of the vane slot to allow better wear distribution of the spring and thereby decrease spring failures.

Another object of the present invention is to provide a vane spring having an offset in the base member to allow a larger portion of the vane to remain in the vane slot to support the pressure loaded cantilevered portion of the vane at maximum vane extension.

Another object of the present invention is to provide a vane spring having curved arm members to reduce the space required in the vane slot by the fully retracted spring.

These and other objects, features and advantages of the present invention will become more apparent from the following description when taken in connections with the accompanying drawings.

BRIEF DESCRIPTION OF THE DRAWINGS

FIG. 1 is a cross-sectional view of a vane-type air motor.

FIG. 2 depicts a conventional vane spring in a fully extended position in a rotor slot.

FIG. 3 depicts a conventional vane spring in a fully retracted position in a rotor slot.

FIG. 4 depicts the vane spring of the present invention in a fully extended position in a rotor slot.

FIG. 5 depicts the vane spring of the present invention in a fully retracted position in a rotor slot.

DETAILED DESCRIPTION OF THE PREFERRED EMBODIMENT

Referring to FIG. 1, a typical fluid power converter such as a vane-type air motor is shown generally by 10. The motor includes a cylindrical rotor 12 eccentrically mounted for rotation in an enclosed cylinder 14. The rotor includes a circumferential surface 16 and a plurality of radial vane slots 18. Each slot contains a slidable vane 20. The vanes are biased in the slots so that the outer edge of the vane remains in contact with the inner surface 22 of the cylinder during rotation. When motive fluid enters the cylinder it strikes the cantilevered vanes and causes the rotor to rotate in the conventional manner.

A biasing mechanism such as a vane spring 30 is typically used at the inner radial position of the vane slot to bias the vane 20 radially outward into sealing contact with the inner surface of the cylinder. A conventional double torsion spring used for this purpose is shown in FIGS. 2 and 3. The spring includes two torsion coils 40 connected by a straight base member 42 which abuts the base edge of the vane 20. The vane rubs against base member 42, subjecting it to eventual failure. A straight arm member 44 extends from each coil. The tips 46 of the arm members are rounded and constantly slide along the bottom 48 of the rotor slots 18 as the motor rotates. The sliding contact of the spring is limited to the very small area of the rounded tips, and therefore is subject to extreme wear and failure.

FIG. 2 shows the conventional spring fully extended and the vane at maximum vane extension beyond the rotor surface represented by line 16. When the spring is fully extended, the portion of the vane 20 that projects from the slot 18 and is exposed to the pressure of the motive fluid is a maximum. The portion of the vane that remains in the slot to support the projecting portion is a minimum. Thus the support for the cantilevered vane is at a minimum in this condition. The vane is subject to misalignment and increased wear at its sealing edge due to the minimal support provided the vane. To provide more support for the vane, it is desirable to make the vane radially taller. The straight base member 42 of the conventional spring prevents a taller vane.

Referring now to FIGS. 4 and 5, an improved vane spring of the present invention is shown which reduces spring wear and failure and allows more vane support at maximum vane extension. The spring includes two torsion coils 50. The base member 52 connecting the two coils is offset radially away from the base of the vane.

This allows the center section 54 of the vane base to be extended in height. A curved arm member 56 having an arc or bow shape as shown in FIGS. 4 and 5 extends from each coil. The curvature of the arms is approximately equal to the offset 52 of the base member. The tips 58 of the arm members are rounded.

The offset 52 in the base member connecting the two coils reduces the bending moments in the spring during operation. The offset also eliminates the rubbing contact with the vane. Both of these results in few spring failures.

The offset also allows the vane to be taller in radial height. This allows the extended section 54 of the vane to remain in the slot (i.e. above line 16) at maximum vane extension as shown in FIG. 4. The portion of the vane that projects from the slot remains the same. Thus a larger portion of the vane is providing support.

A taller vane is desirable since it provides a greater support for the cantilevered portion of the vane that is exposed to the motive fluid during maximum vane extention. More support for the projecting portion of the vane reduces the wear on the vane sealing edge.

The curved arms 56 also provide better wear distribution. As best shown in FIG. 5, the curved arms increases and changes the contact point of the spring arm with the bottom of the vane slot. As the spring deflects, the contact point may extend from a position on the rounded tip 58 to a position on the arm 56 itself as shown in FIG. 5. This allows better wear distribution and reduces spring failure.

Changes and modifications in the specifically described embodiments can be carried out without departing from the scope of the invention which is intended to be limited only by the scope of the appended claims.

What is claimed is:

1. A spring for biasing a slidable vane in a slot comprising:

first and second torsion coils;

a base member connecting one end of said first torsion coil with one end of said second torsion coil, said base member having a curved offset portion between said coils; and first and second spring arm members extending respectively from the other ends of each of said first and second torsion coils, said arm members having an arc shape wherein said base member is offset toward said arm members and said arm members are arced away from said base member.

2. The spring according to claim 1 wherein the spring is constructed from a single wire.

3. The spring according to claim 1 wherein the extending ends of said curved arm members have rounded tips.

4. In combination, a slidable vane and biasing spring assembly for an air motor comprising:

a vane having an outside edge adapted for sealing contact with a cylinder of the air motor and a contoured inside edge having an extending portion; and a wire spring having first and second torsion coils, a curved offset base member connecting said first and second torsion coils, said base member having a curved shape adapted to fit around said extending portion of said vane, and first and second curved arm members having an arc shape and extending respectively from said first and second torsion coils.

* * * * *